US006419451B1

(12) United States Patent
Moody et al.

(10) Patent No.: US 6,419,451 B1
(45) Date of Patent: Jul. 16, 2002

(54) CEILING FAN BLADE FRAME

(75) Inventors: John F. Moody, Moro, IL (US); Edward M. Springer, Chesterfield; Maria Livits, St. Louis, both of MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/784,678

(22) Filed: Feb. 15, 2001

(51) Int. Cl.[7] ..... F04D 29/34
(52) U.S. Cl. ..... 416/210 R; 416/241 R
(58) Field of Search ..... 416/132 A, 204 R, 416/210 R, 223 R, 226, 241 R

(56) References Cited

U.S. PATENT DOCUMENTS

| | | | | | |
|---|---|---|---|---|---|
| 1,516,668 | A | * | 11/1924 | Burch | 416/118 |
| 1,841,959 | A | * | 1/1932 | Kingsbury | 416/204 R |
| D309,183 | S | * | 7/1990 | Taylor, III | D23/413 |
| D313,467 | S | * | 1/1991 | Frampton | D23/379 |
| D321,935 | S | * | 11/1991 | Ignon | D23/413 |
| 5,110,261 | A | | 5/1992 | Junkin | 416/204 R |
| 5,338,156 | A | * | 8/1994 | Chien | 416/132 A |
| 5,462,407 | A | * | 10/1995 | Calvo | 416/132 A |
| D432,640 | S | | 10/2000 | Frampton | D23/413 |
| D433,118 | S | | 10/2000 | Frampton | D23/413 |
| D433,119 | S | | 10/2000 | Frampton | D23/413 |
| D433,498 | S | | 11/2000 | Frampton | D23/413 |
| D433,747 | S | | 11/2000 | Frampton | D23/413 |
| D433,748 | S | | 11/2000 | Frampton | D23/413 |
| D433,749 | S | | 11/2000 | Frampton | D23/413 |
| D434,134 | S | | 11/2000 | Frampton | D23/413 |
| 6,155,787 | A | * | 12/2000 | Hodgkins, Jr. | 416/210 R |
| D437,047 | S | | 1/2001 | Frampton | D23/413 |
| D437,406 | S | | 2/2001 | Frampton | D23/413 |
| D438,610 | S | | 3/2001 | Frampton | |

* cited by examiner

*Primary Examiner*—John E. Ryznic
(74) *Attorney, Agent, or Firm*—Howrey Simon Arnold & White, LLP

(57) ABSTRACT

A fan blade frame provides a suitable connection for securely connecting a fan blade to a conventional blade iron. A first frame member generally defines the outer periphery of the fan blade. A plate is fixedly attached to the base end of the first frame member, and may additionally attached to a second frame member that is connected to the base end of the first frame member. The plate and first frame member form a rigid unit that provides support to a light-weight or non-rigid blade material such as wicker, natural leaf, cloth, etc. The plate defines a plurality of openings therethrough for connection to a conventional fan blade iron.

22 Claims, 3 Drawing Sheets

CEILING FAN BLADE FRAME

BACKGROUND OF THE INVENTION

1.Field of the Invention

This invention relates generally to ceiling fans, and more particularly, to a blade fame forming a rigid unit for holding ceiling fan blade material.

2. Description of Related Art

Ceiling fans are well known, and typically include a plurality of blades extending from a motorized hub for rotation therewith to circulate air in a room. Ceiling fan blades are typically fabricated from wood and are attached to the hub via a standardized "blade arm" or "blade iron" or "flange" having three or four bores extending through one end of the blade iron. The bores in the blade iron are matched with corresponding bores extending through the blades, and the blades are secured to the blade iron with bolts or screws, or other suitable attachment means. The opposite end of the blade iron is secured to the rotating part of the fan motor to rotate the blades. FIG. 1A shows a typical wood ceiling fan blade 1 having three holes 2 extending therethrough for connecting the blade 1 to a blade iron. FIG. 1B illustrates the fan blade 1 connected to a blade iron 3.

Materials other than wood may be used for fabricating ceiling fan blades. Non-rigid, light-weight blades may be constructed of fabric such as cloth or canvas, or other light-weight materials such as woven wicker or natural leaf. Due to the flexible nature of these types of light-weight blade materials, a frame is required to form the blade shape and support the blade material. Even if the blade material is capable of generally forming the blade shape, a rigid blade frame for these flexible blade materials prevents a ceiling fan blade from flexing under the load of the air velocity at a high fan speed.

Some known non-rigid blades may be attached to an "open" frame—the frame is constructed from a single rod bent into the general shape of the blade, and one or both of the ends of the rod are connected to a blade iron. This type of blade construction is disclosed, for example, in U.S. Pat. No. Des. 306,643 to Taylor, III. Connecting the ends of the rod to a standard blade iron such as that shown in FIG. 1B is generally unsatisfactory, since the connection would not provide the required support of the blade. Therefore, a specially designed blade iron or flange, or other connection apparatus is required. Further, the open frame does not form a rigid structure until it is attached to the special blade iron, possibly resulting in damage to the blade prior to its attachment to the blade iron.

Other non-rigid blades use a "closed" frame—the frame member is bent into the general blade shape and the ends are connected together to form a continuous member. Woven wicker or other materials are connected to the frame member to form the fan blade. A conventional blade iron is not suited to attach a closed frame blade to the ceiling fan motor. Rather, a special attachment mechanism is used in which upper and lower members "sandwich" the fan blade. Such a sandwich arrangement is conceptually illustrated in FIG. 2, which shows a connection apparatus 4 for a prior art fan blade. The connection apparatus 4 of FIG. 2 includes upper and lower members 5, 6 that are situated above and below the fan blade 7. Bolts or screws 8 extend through the upper and lower members 5,6 and the blade 7 to secure the blade to the apparatus 4. The type of attachment arrangement shown in FIG. 2 often does not provide a robust connection as is desired to securely connect the blades to the motor.

Thus, if a fan manufacturer offers both rigid and non-rigid, light-weight blades, multiple types of blade irons are required, which results in added costs. Additionally, if a user desires to replace typical wooden blades with wicker or natural leaf blades, for example, the existing blade irons must be discarded and special blade irons must be purchased.

The present invention addresses shortcomings associated with the prior art.

SUMMARY OF THE INVENTION

In one aspect of the invention, a fan blade frame includes a first frame member generally defining the outer periphery of a fan blade. A plate is fixedly attached to the base end of the first frame member. The plate defines a plurality of openings therethrough for connection to a conventional fan blade iron. The first frame member is fixedly attached to the plate to form a single rigid unit to provide support for blade material, even when it is not attached to a blade iron.

In certain embodiments, at least one support member is attached between the plate and the first frame member. A second frame member may further be included that has first and second ends each connected proximate to the base end of the first frame member. The support member in such an embodiment is attached to the second frame member between its first and second ends. The plate is also attached to the second frame member. The frame members may comprise steel wire, for example. The plate, frame members, and support members may be connected by welding.

In accordance with further aspects of the invention, a fan blade includes a first frame member generally defining the outer periphery of the fan blade. A second frame member has first and second ends each connected proximate to the base end of the first frame member. A plate is attached to the base end of the first frame member and the second frame member, and the plate has a plurality of openings therethrough for connection to a conventional fan blade iron. Blade material, such as woven wicker, cloth or a natural leaf is attached to the first and second frame members.

BRIEF DESCRIPTION OF THE DRAWINGS

Other objects and advantages of the invention will become apparent upon reading the following detailed description and upon reference to the drawings in which.

Figure 1A:
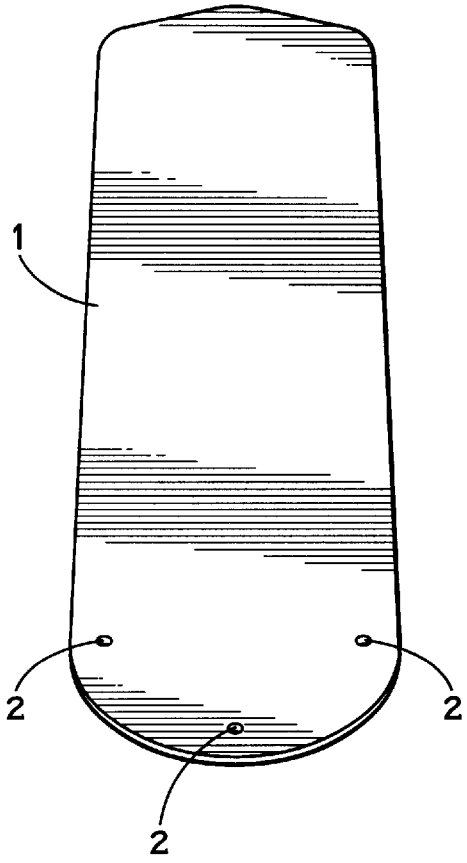
FIG. 1A (PRIOR ART)
FIGS. 1A and 1B are perspective views of a prior art fan blade and blade iron.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' Is specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 3:
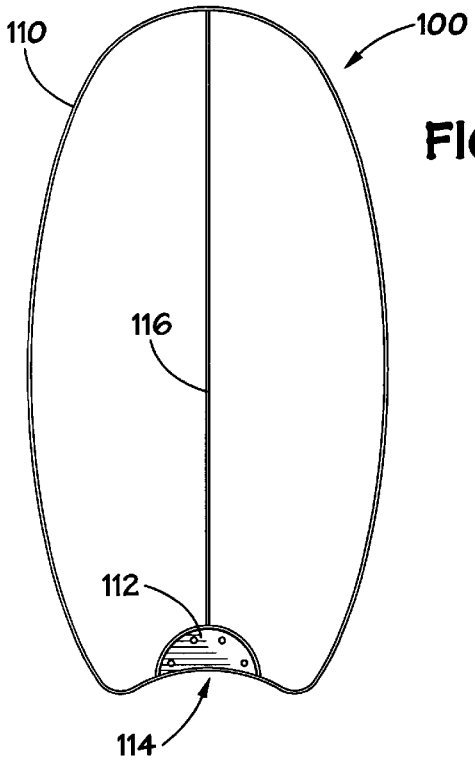
FIG. 3 illustrates a fan blade frame in accordance with an embodiment of the present invention.

FIG. 3 generally illustrates a fan blade frame 100 in accordance with aspects of the present invention. A frame member 110 generally defines the outer periphery of a fan blade. As noted in the background section hereof, typical ceiling fan blades are fabricated from a rigid material such as wood. Other types of blades are fabricated from lightweight and/or non-rigid blade materials, such as woven wicker, cloth or natural leaf. These non-rigid materials require a frame to form the shape of the blade, such as the frame 100 shown in FIG. 3, due to their flexible nature. Even if the material is of a type that could generally retain the fan blade shape without a frame, a rigid blade frame prevents a ceiling fan blade from flexing under the load of the air velocity at a high rotation speed. The fan blade frames disclosed are generally applicable to any type of fan blade that requires a frame.

The exemplary frame member 110 is closed—it forms a continuous member. In other embodiments, the frame member does not necessarily form a closed, continuous member. A flat plate 112 is fixedly attached to a base end 114 of the frame member 110, and has a plurality of openings therethrough for connection to a conventional fan blade iron (not shown), such as the blade iron 3 shown in FIG. 1A. The terms "blade iron," "blade arm," and "blade flange" are used interchangeably in this specification. A support member 116 is attached to the plate 112 and the frame member 110.

Figure 4A:
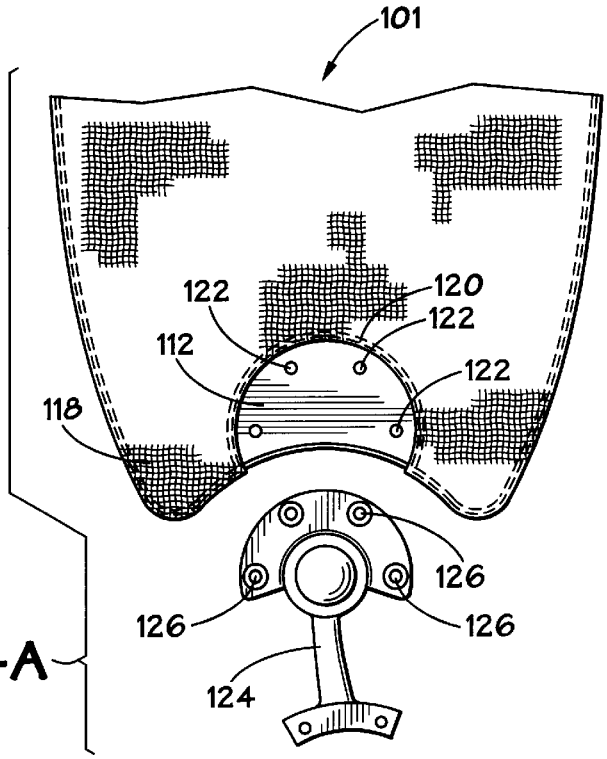
FIGS. 4A and 4B are partial bottom and top perspective views, respectively, of a fin blade in accordance with an embodiment of the present invention.
Figure 4B:
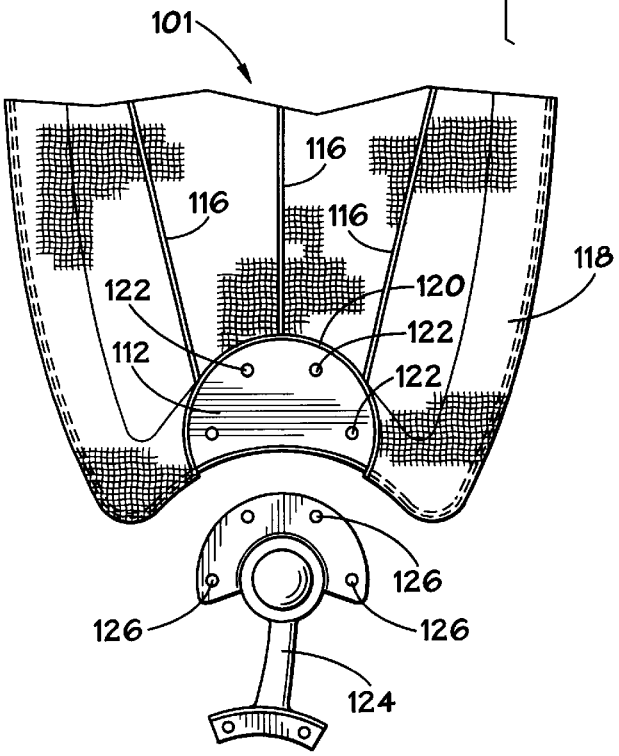

FIGS. 4A and 4B illustrate portions of a fan blade 101 in accordance with an embodiment of the present invention. FIG. 4A is a bottom view of the fan blade 101—it illustrates the side of the blade that would be seen from the floor looking up at a ceiling fan. FIG. 4B is a top view, which shows the opposite side of the blade 101—the side facing the ceiling when the blade is installed on a ceiling fan. The fan blade 101 includes a frame member 110, which, as in the blade 100 shown in FIG. 3, generally defines the outer periphery of the fan blade 101. Only the base end 114 of the frame member 110 is visible in FIGS. 4A and 4B, as a natural leaf 118 is attached to the frame member 110 to form the blade 101.

Opposite ends of a second frame member 120 are attached to the base end 114 of the frame member 110 to form a generally semicircular shape. A plate 112 is attached to both the second frame member 120 and the base end 114 of the first frame member 110. As shown in FIGS. 4A and 4B, the second frame member 120 and the plate 112 are situated within the periphery of the frame member 110. In other embodiments, the plate 112 and second frame member 120, if used, may be positioned differently relative to the first frame member 110. For instance, the plate 112 may be fastened to the base end 114 such that it extends partially or completely out of the periphery of the first frame member 110.

Three support members 116 are attached to the second frame member 120 and the first frame member 110 generally opposite the base end 114. In the illustrated embodiment, spot welds fixedly attach the second frame member 120 to the base end 114, the plate 112 to the second frame member 120 and the base end 114, and the support members 116 to the first and second frame members 110, 120.

Figure 1B:
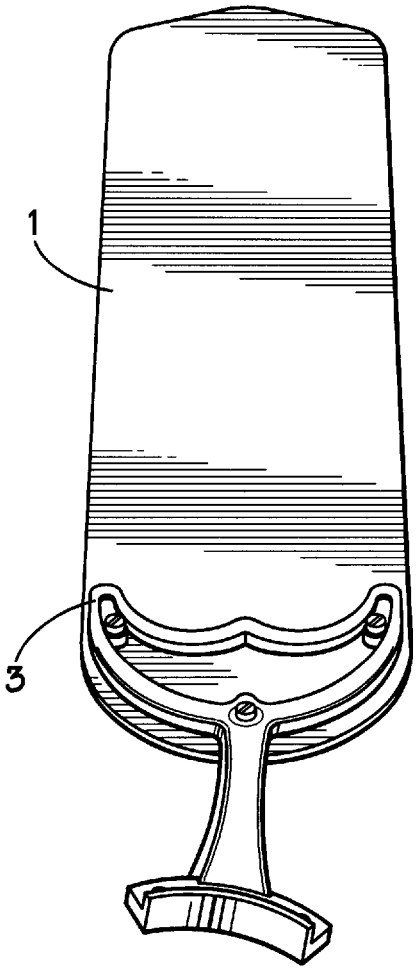
FIG. 1B (PRIOR ART)
Figure 2:
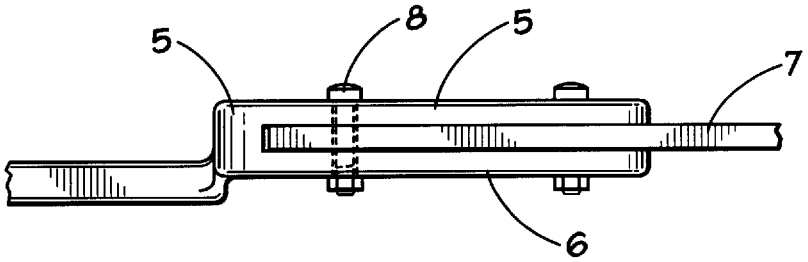
FIG. 2 (PRIOR ART)
FIG. 2 is a partial side view of a prior art blade connector.

Four holes 122 extend through the plate 112 for attaching the blade 101 to a conventional blade iron 124. The holes 122 correspond to four holes 126 extending through the blade iron 124. Suitable fastening members, such as screws or bolts, extend through the holes 122, 126 to attach the fan blade 101 to the blade iron 124 in the same manner that a conventional wood fan blade would be attached to a blade iron, as shown in FIG. 1B.

In certain exemplary embodiments, the first and second frame members 110, 120 each are comprised of 0.192 inch diameter #6 gage steel wire bent into the desired shape, and 0.162 inch diameter #8 gage steel wire is used for the support members 116. A suitable material for the plate 112 is 0.179 inch thick #7 gage steel. In other embodiments, the frame, support members and plate are constructed from other materials, such as plastic or wood. As noted above, a natural leaf 118, such as a dried palm or banana leaf, is attached to the frame and support members 110, 120, 116 to form the blade 101. Several other materials may be connected to the frame members, such as wicker, cloth or canvas.

Figure 5A:
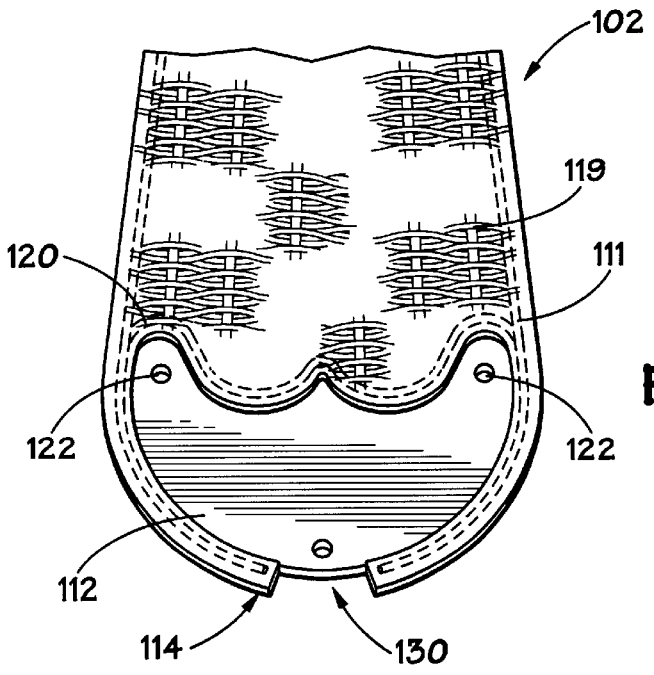
FIGS. 5A and 5B are partial perspective views of a fan blade in accordance with another embodiment of the present invention.
Figure 5B:
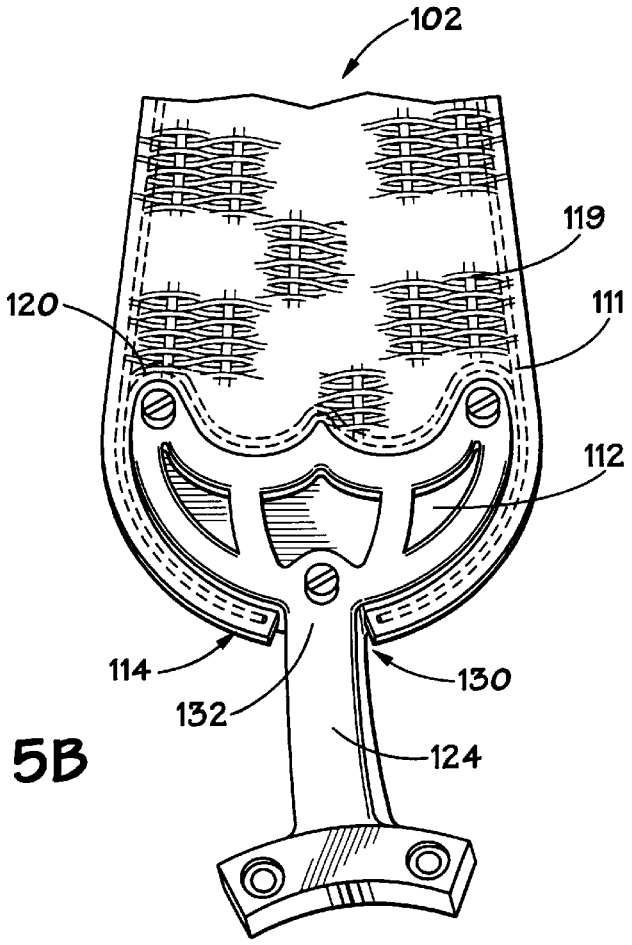

FIGS. 5A and 5B illustrate yet another fan blade 102 in accordance with embodiments of the present invention. In the blade 102, the first and second frame members 111, 120 are both bent into different shapes then those of the embodiment shown in FIGS. 4A and 4B, and a support member is not required as the blade 102 is smaller than the blade 101 of FIGS. 4A and 4B. Moreover, the first frame member 111 shown in FIGS. 5A and 5B does not form a continuous member. There is a gap 130 between the ends of the first frame member 111 at the base end 114. In one embodiment, the gap 130 formed by the first frame member 111 is about one inch wide.

Even though the first frame member 111 does not form a closed frame, the combination of the non-continuous member 111 and the plate 112 forms a single rigid unit, as the ends of the first frame member 110 are welded to the plate 112. Thus, the blade 102 maintains its shape even when it is not connected to a blade iron. Prior art open frame blades generally rely on a connection to a blade iron to provide rigidity. As shown in FIG. 5B, a throat portion 132 of the blade iron 124 is situated in the gap 130. In the blade 102, the first and second frame members 110, 120 are substantially covered by woven wicker 119 that forms the fan blade.

As shown in FIG. 5A, there are three holes 122 extending through the plate 112 for connecting the blade 102 to a conventional blade iron 124. As with the blade 101 shown in FIGS. 4A and 4B, the second frame member 120 and the plate 112 are situated within the periphery of the first frame member 110 though other positions are contemplated. FIG. 5B illustrates the blade 102 connected to the conventional blade iron 124 via the plate 112.

As noted above, the fan blades 101, 102 disclosed herein provide non-wooden blades that are attachable to a ceiling fan using conventional blade irons, thus eliminating the need and associated expense for special blade connection means. A ceiling fan owner can replace standard wood blades with stylish wicker blades, for example, using the standard blade irons provided with the ceiling fan. Further, the frame member 110 and plate 112 combination provide a single rigid unit that maintains the shape of the blade even in the absence of a blade iron.

It will be appreciated by those of ordinary skill in the art having the benefit of this disclosure that the embodiment illustrated above is capable of numerous variations without departing from the scope and spirit of the invention. It is fully intended that the invention for which a patent is sought encompasses within its scope all such variations without being limited to the specific embodiment disclosed above. Accordingly, the exclusive rights sought to be patented are as described in the claims below.

What is claimed is:

1. A fan blade frame, comprising:

a first frame member generally defining the outer periphery of a fan blade, the frame having a base end; and a plate fixedly attached to the base end of the first frame member, the plate defining a plurality of openings therethrough for connection to a conventional fan blade iron.

2. The fan blade frame of claim 1, wherein the first frame member forms a closed frame.

3. The fan blade frame of claim 1, further comprising at least one support member having a first end affixed to the plate and a second end affixed to the first frame member.

4. The fan blade frame of claim 1, further comprising:

a second frame member having first and second ends, the first and second ends each being connected to the base end of the first frame member; and the plate being further attached to the second frame member.

5. The fan blade frame of claim 4, further comprising at least one support member having first and second ends, the first end being affixed to the to the second frame member between the first and second ends of the second frame member, the second end being affixed to the first frame member.

6. The fan blade frame of claim 1, wherein the plate is situated within the periphery of the fame.

7. The fan blade frame of claim 1, wherein the first frame member comprises steel wire bent into the general fan blade shape.

8. The fan blade frame of claim 4, wherein the first and second frame members each comprise steel wire.

9. The fan blade of frame of claim 8, wherein the first and second ends of the second frame member are welded to the base end of the first frame member, and the flat plate is welded to the second frame member.

10. The fan blade frame of claim 1, wherein the first frame member defines a gap at the base end.

11. A fan blade, comprising, a first frame member generally defining the outer periphery of the fan blade, the frame having a base end;

a second frame member having first and second ends, the first and second ends each being attached to the first frame member proximate the base end;

a plate attached to the base end of the first frame member and the second frame member, the plate defining a plurality of openings therethrough for connection to a conventional fan blade iron; and blade material attached to the first and second frame members to form the fan blade.

12. The fan blade of claim 11, wherein the first frame member forms a closed frame.

13. The fan blade of claim 11, further comprising at least one support member having a first end attached to the first frame member and a second end attached to the second frame member, the second frame member and the support member being situated 4 within the periphery of the first frame member.

14. The fan blade of claim 11, wherein the blade material comprises wicker.

15. The fan blade of claim 11, wherein the blade comprises natural leaf.

16. The fan blade of claim 11, wherein the blade material comprises cloth.

17. The fan blade of claim 11, wherein the plate is situated within the periphery of the frame.

18. The fan blade of claim 11, wherein the flat plate is situated within the periphery of the frame.

19. The fan blade of claim 11, wherein first and second frame members each comprise steel wire.

20. The fan blade of claim 11, wherein the first frame member defines a gap at the base end.

21. The fan blade frame of claim 11, further comprising a blade iron attached to the plate.

22. The fan blade frame of claim 20, further comprising a blade iron attached to the plate, wherein a portion of the blade iron is situated within the gap.

* * * * *

UNITED STATES PATENT AND TRADEMARK OFFICE

CERTIFICATE OF CORRECTION

PATENT NO. : 6,419,451 B1 
DATED : July 16, 2002
INVENTOR(S) : John F. Moody, Edward M. Springer and Maria Livits It is certified that error appears in the above-identified patent and that said Letters Patent is hereby corrected as shown below:

Column 6,
Line 22, delete "4"

Signed and Sealed this

Twenty-ninth Day of April, 2003

JAMES E. ROGAN
*Director of the United States Patent and Trademark Office*